US009234673B2

(12) United States Patent
Douglas et al.

(10) Patent No.: US 9,234,673 B2
(45) Date of Patent: Jan. 12, 2016

(54) HEAT EXCHANGER WITH SUBCOOLING CIRCUIT

(75) Inventors: Jonathan David Douglas, Lewisville, TX (US); Kevin B. Mercer, Troup, TX (US); Benton A. Harris, Jr., Tyler, TX (US); Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 104 days.

(21) Appl. No.: 13/276,000

(22) Filed: Oct. 18, 2011

(65) Prior Publication Data

US 2013/0092355 A1 Apr. 18, 2013

(51) Int. Cl.

| | |
|---|---|
| ***F25D 21/14*** | (2006.01) |
| ***F24F 13/22*** | (2006.01) |
| ***F24F 1/00*** | (2011.01) |

(52) U.S. Cl.

CPC ..... *F24F 13/222* (2013.01); *F24F 1/0007* (2013.01); *Y10T 29/4935* (2015.01)

(58) Field of Classification Search

CPC ..... F25B 40/22; F25B 39/22
USPC ..... 62/285, 291, 333, 513, 524, 526
See application file for complete search history.

(56) References Cited

U.S. PATENT DOCUMENTS

| | | | | |
|---|---|---|---|---|
| 4,262,493 | A * | 4/1981 | Lackey et al. | 62/324.6 |
| 4,448,597 | A | 5/1984 | Kuwabara et al. | |
| 4,483,156 | A * | 11/1984 | Oudenhoven | 62/324.1 |
| 4,683,726 | A | 8/1987 | Barron | |
| 5,088,295 | A | 2/1992 | Shapiro-Baruch | |
| 5,212,965 | A * | 5/1993 | Datta | 62/515 |
| 5,379,833 | A * | 1/1995 | Mathews | 165/113 |
| 5,400,609 | A | 3/1995 | Sjoholm et al. | |

(Continued)

FOREIGN PATENT DOCUMENTS

| | | | |
|---|---|---|---|
| CA | 1210944 | A1 | 9/1986 |
| CN | 1409075 | A | 4/2003 |

(Continued)

OTHER PUBLICATIONS

Chinese Office Action; Application No. 201210393633.4; dated Sep. 2, 2014; 36 pages.

(Continued)

*Primary Examiner* — Jonathan Bradford
*Assistant Examiner* — Elizabeth Martin
(74) *Attorney, Agent, or Firm* — Conley Rose, P.C.; J. Robert Brown, Jr.; Michael J. Schofield

(57) ABSTRACT

An air handling unit has a blower configured to selectively move air from an air inlet of the air handling unit to an air outlet of the air handling unit along an airflow direction extending from the blower to the air outlet, a heat exchanger disposed within the air handling unit between the inlet and the outlet, the heat exchanger has a thermal conductor, an evaporator tube thermally conductively joined to the thermal conductor, and a subcooler tube thermally conductively joined to the thermal conductor. An expansion device provides fluid communication between the evaporator tube and the subcooler tube and a drain pan disposed within the air handling unit upstream relative to the at least one subcooler tube and positioned in a geometrical footprint of at least a portion of the drain pan as the drain pan is viewed from an upstream position in the airflow direction.

15 Claims, 5 Drawing Sheets

(56) References Cited

U.S. PATENT DOCUMENTS

| | | | | |
|---|---|---|---|---|
| 5,509,272 | A | 4/1996 | Hyde | |
| 5,634,349 | A * | 6/1997 | Kakehashi et al. | 62/198 |
| 6,758,054 | B2 | 7/2004 | Zheng et al. | |
| 6,973,804 | B2 * | 12/2005 | Horiuchi et al. | 62/513 |
| 7,104,079 | B2 | 9/2006 | Kuwabara et al. | |
| 7,185,513 | B2 * | 3/2007 | Bush et al. | 62/515 |
| 7,418,826 | B2 * | 9/2008 | Rios et al. | 62/285 |
| 2004/0020230 | A1 | 2/2004 | Kuwabara et al. | |
| 2009/0025914 | A1 * | 1/2009 | Knight | F25B 39/00 165/144 |

FOREIGN PATENT DOCUMENTS

| | | | |
|---|---|---|---|
| CN | 1825032 | A | 8/2006 |
| JP | 2004293904 | A | 10/2004 |
| JP | 2008075998 | A | 4/2008 |
| JP | 2010274828 | A | 12/2010 |
| KR | 100544716 | B1 | 1/2006 |

OTHER PUBLICATIONS

Chinese Office Action; Application No. 201210393633.4; Mar. 13, 2015; 8 pages.

Chinese Office Action; Application No. 201210393633.4; Sep. 28, 2015; 7 pages.

* cited by examiner

HEAT EXCHANGER WITH SUBCOOLING CIRCUIT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The Air-Conditioning, Heating, and Refrigeration Institute (AHRI) defines several tests for heating, ventilation, and air conditioning (HVAC) systems designed to mimic real-world conditions. The tests are specified in "AHRI 210/240-2008: 2008 Standard for Performance Rating of Unitary Air-Condition and Air-Source Heat Pump Equipment," which is herein incorporated by reference. Of particular interest are two tests for two-speed or variable-speed compressors—the "A" test and the "F" test. The "A" test is a test conducted at a high compressor capacity with 95° F. air entering the outdoor unit, and the "F" test is a test conducted at a low compressor capacity with 67° F. air entering the outdoor unit. These tests are directed to so-called split HVAC systems comprising an indoor unit and an outdoor unit. These tests represent relatively extreme operating conditions for an HVAC cooling system.

One way to achieve a high Energy Efficiency Ratio (EER) and thereby affecting the Seasonal Energy Efficiency Ratio (SEER) rating for an HVAC system in the AHRI "A" test is to optimize charge for the "A" test. However, as a result of optimizing charge according to the "A" test, there may be a significant loss of subcooling in the AHRI "F" test. Conventionally, in order to remedy this, additional charge may be added to achieve sufficient subcooling for the "F" test. Adding this additional charge to provide sufficient performance for the "F" test presents a problem for the "A" test because charge is no longer optimized for the "A" test and the EER at the "A" test is accordingly decreased. The "A" and "F" tests can thus place competing demands on an HVAC system.

SUMMARY OF THE DISCLOSURE

In some embodiments, an air handling unit is disclosed as comprising a blower configured to selectively move air from an air inlet of the air handling unit to an air outlet of the air handling unit along an airflow direction extending from the blower to the air outlet and a heat exchanger disposed within the air handling unit between the inlet and the outlet. The heat exchanger may comprise a thermal conductor, at least one evaporator tube thermally conductively joined to the thermal conductor, and at least one subcooler tube thermally conductively joined to the thermal conductor. The air handling unit may further comprise an expansion device providing fluid communication between at least one evaporator tube and at least one subcooler tube and a drain pan disposed within the air handling unit upstream relative to at least one subcooler tube and positioned in a geometrical footprint of at least a portion of the drain pan as the drain pan is viewed from an upstream position in the airflow direction.

In some embodiments, an HVAC system comprising a heat exchanger comprising a thermal conductor, at least one evaporator tube thermally conductively joined to the thermal conductor, and at least one subcooler tube thermally conductively joined to the thermal conductor is disclosed. The HVAC system may further comprise an expansion device providing fluid communication between at least one evaporator tube and at least one subcooler tube and a drain pan comprising a concavity configured to receive condensate from the heat exchanger when the concavity is generally open in a vertically upward direction, wherein at least a portion of at least one of at least one subcooler tube and the thermal conductor is received within the concavity.

In some embodiments, a method of assembling an air handling unit is disclosed. The method may comprise providing a heat exchanger, the heat exchanger comprising a thermal conductor, at least one evaporator tube thermally conductively joined to the thermal conductor, and at least one subcooler tube thermally conductively joined to the thermal conductor. The heat exchanger may further comprise an expansion device providing fluid communication between at least one evaporator tube and at least one subcooler tube. The method may further comprise mounting a housing in a surrounding relationship to said heat exchanger, the housing comprising an air inlet and an air outlet, providing a blower within the housing positioned to move air from the air inlet to the air outlet of the housing along an airflow direction extending from the blower to the air outlet, and positioning a drain pan within the housing upstream relative to at least one subcooler tube so that at least one subcooler tube lies in a geometrical footprint of at least a portion of the drain pan as the drain pan is viewed from an upstream position in the airflow direction.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some embodiments presented in this application may be directed to air handling units and/or evaporators of HVAC and/or refrigeration units. Some embodiments comprise features and/or components that may improve a performance balance between the competing demands of the "A" and "F" tests. In other words, some embodiments may not only provide efficiency at higher ambient outdoor temperatures but also provide sufficient subcooling at lower ambient outdoor temperatures. Some embodiments may accomplish this objective by trading some conventional cooling capacity of an indoor heat exchanger (or evaporator) for subcooling capability. Some embodiments may also be directed to methods of manufacturing HVAC components configured to perform in the above-described manner.

Figure 1:
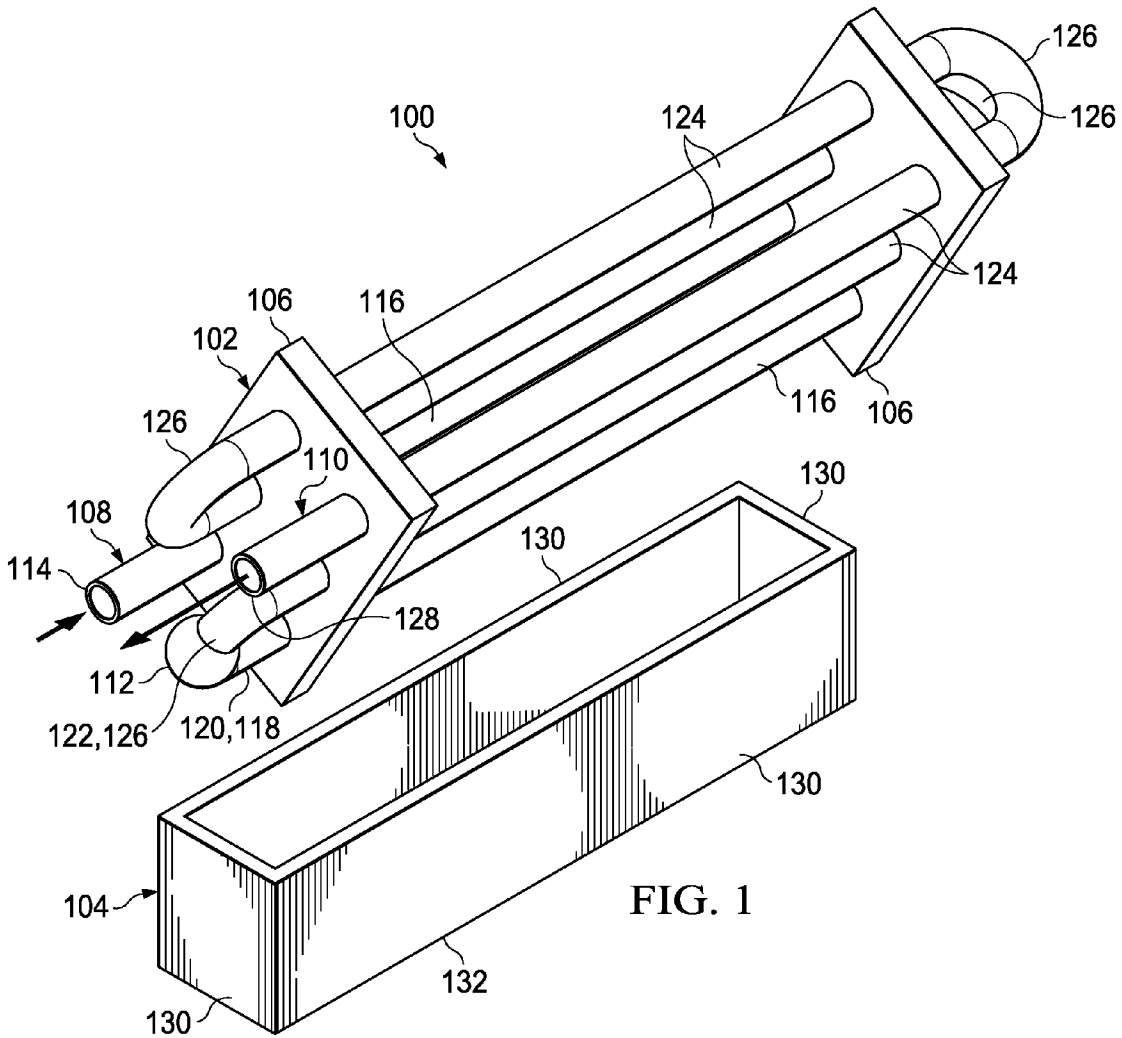
FIG. 1 is a partial oblique view of an air handling unit according to an embodiment of the disclosure.

Referring now to FIG. 1, a partial oblique view of an air handling unit 100 is shown. Most generally, the air handling unit 100 comprises a heat exchanger 102 and a drain pan 104. The air handling unit 100 may be configured for use in an indoor unit of a split HVAC system. The heat exchanger 102 is configured to receive a substance, such as refrigerant, that may facilitate heat transfer in an HVAC system. Most generally, the heat exchanger 102 comprises opposing end plates 106 that at least partially carry a subcooling circuit 108, an evaporator circuit 110, and a refrigerant expansion device 112.

In some embodiments, the subcooling circuit 108 may comprise a subcooler inlet 114 configured to receive refrigerant into the subcooling circuit 108. The subcooling circuit 108 may further comprise one or more substantially straight subcooler tubes 116 that may be connected by one or more subcooler hairpin joints 118 (alternatively referred to as U-tubes or U-joints). The subcooling circuit 108 further comprises a subcooler outlet 120 configured to allow passage of refrigerant out of the subcooling circuit 108. It will be appreciated that while the above-described subcooler inlet 114 and subcooler outlet 120 inherently indicate a direction of refrigerant flow in a direction through the subcooling circuit 108 from the subcooler inlet 114 to the subcooler outlet 120, in some embodiments, refrigerant flow may occur in a reverse direction.

In some embodiments, the evaporation circuit 110 may comprise an evaporator inlet 122 configured to receive refrigerant into the evaporation circuit 110. The evaporation circuit 110 may further comprise one or more substantially straight evaporator tubes 124 that may be connected by one or more evaporator hairpin joints 126 (alternatively referred to as U-tubes or U-joints). The evaporation circuit 110 further comprises an evaporator outlet 128 configured to allow passage of refrigerant out of the evaporation circuit 110. It will be appreciated that while the above-described evaporator inlet 122 and evaporator outlet 128 inherently indicate a direction of refrigerant flow in a direction through the evaporation circuit 110 from the evaporator inlet 122 to the evaporator outlet 128, in some embodiments, refrigerant flow may occur in a reverse direction.

The expansion device 112 may be a thermal expansion valve or an electronic expansion valve or an orifice or any other means of creating pressure drop and 'expanding' refrigerant from high to low pressure. The expansion device 112 may control an amount of refrigerant passing through the expansion device 112 and may cause a refrigerant pressure drop as measured across the expansion device 112. In this embodiment, the expansion device 112 is disposed between and is in fluid communication with the subcooler outlet 120 and the evaporator inlet 122. In the embodiment of FIG. 1, the expansion device 112 is shown as being disposed between one half of a subcooler hairpin joint 118 and one half of an evaporator hairpin joint 126.

The drain pan 104 may comprise a substantially open box-shaped structure. Specifically, the drain pan 104 may comprise four rectangular side walls 130 and a rectangular bottom wall 132. As such, the drain pan may be configured to receive at least some condensate formed on the heat exchanger 102 during operation of the heat exchanger 102. In alternative embodiments, the drain pan 104 may comprise any other suitable shape that is configured to receive condensate formed on the heat exchanger 102 and drained into drain pan 104.

In operation of the air handling unit 100, refrigerant may first enter the heat exchanger 102 through subcooler inlet 114 and travel successively through the straight subcooler tubes 116 and associated subcooler hairpin joints 118 before reaching the subcooler outlet 120. Refrigerant may exit the subcooler outlet 120 and enter the expansion device 112. As refrigerant passes through the expansion device 112, refrigerant may encounter a fluid flow restriction that causes a change in pressure of the refrigerant prior to the refrigerant exiting the expansion device 112. Accordingly, the reduced pressure and/or expanded refrigerant may thereafter exit the expansion device 112 and enter evaporator inlet 122. Refrigerant may then travel successively through the straight evaporator tubes 124 and associated evaporator hairpin joints 126 before reaching the evaporator outlet 128. Refrigerant may ultimately exit the heat exchanger 102 through evaporator output 128. While the embodiment described above discloses inclusion of a plurality of straight subcooler tubes 116 and straight evaporator tubes 124, other embodiments may comprise as few as one straight subcooler tube 116 and straight evaporator tube 124 connected via an expansion device 112. This disclosure also contemplates that the subcooling circuit 108 and the evaporation circuit 110 may comprise any other suitably shaped tubes and/or joints.

In some embodiments, the end plates 106 may be constructed of metal or other relatively good thermally conductive material. In cases where the end plates 106 are constructed of relatively rigid thermally conductive material, not only do the end plates 106 maintain relative locations of the components of the subcooling circuit 108 and the evaporator circuit 110, but the end plates 106 may be employed at least in part to also facilitate conductive heat transfer between one or more of the components of the subcooling circuit 108 and the evaporator circuit 110 as well as to facilitate convective heat transfer generally between the heat exchanger 102 and surrounding air. In alternative embodiments, one or more plate fins that are relatively thinner than end plates 106 may be disposed along the length of the straight subcooler tubes 116 and straight evaporator tubes 124 to facilitate heat transfer between the heat exchanger 102 components and the surrounding air.

Figure 2:
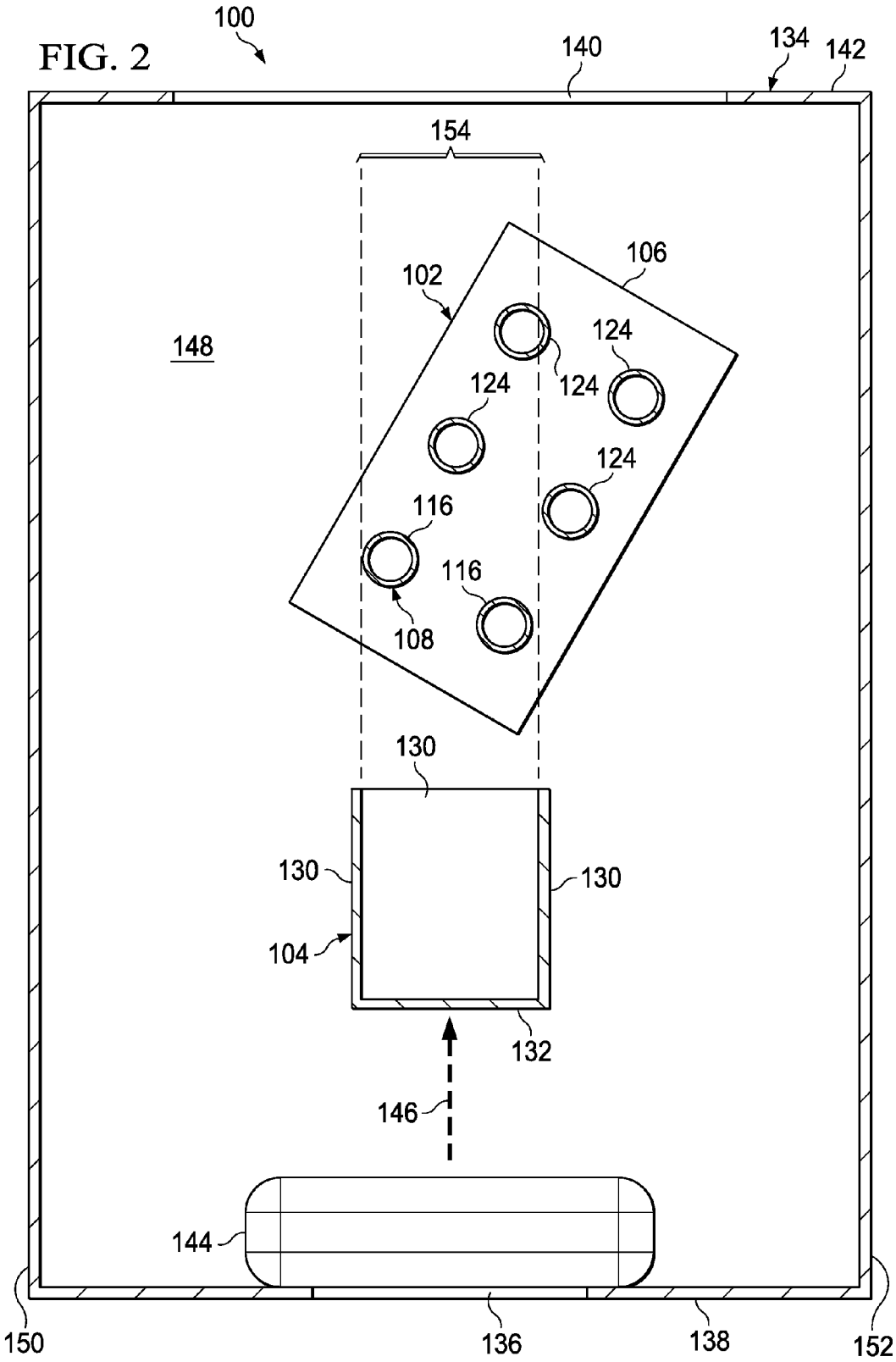
FIG. 2 is a simplified schematic cross-sectional view of the air handling unit of FIG. 1.

Referring now to FIG. 2, a simplified schematic cross-sectional view of the air handling unit 100 is shown. As compared to FIG. 1, the air handling unit 100 is illustrated as further comprising a cabinet 134 substantially enveloping the heat exchanger 102 and drain pan 104. The cabinet 134 may serve to form a fluid duct that receives air through an air inlet 136 at a bottom side 138 and expel air through an air outlet 140 at a top side 142. The air handling unit 100 may further comprise a blower 144 configured to generate airflow in an airflow direction 146 (represented generally by an arrow). The airflow direction 146 indicates that air flows generally from the blower 144 toward the heat exchanger 102, but that at least a portion of the drain pan 104 may prevent air from reaching the heat exchanger 102 via a substantially straight path.

The cabinet 134 further comprises a front side, a back side 148, a left side 150, and a right side 152, each defined by cabinet walls. It will be appreciated that such directional descriptions are meant to assist the reader in understanding the physical orientation of the various components of the air handling unit 100. However, such directional descriptions shall not be interpreted as limitations to the possible installation orientations of the air handling unit 100. The cabinet walls of the air handling unit 100 substantially surround the heat exchanger 102, drain pan 104, and blower 144. The drain pan 104 may be disposed in the air handling unit 100 upstream relative to at least a portion of the subcooling circuit 108. More particularly, in some embodiments, one or more straight subcooler tubes 116 may be located downstream relative to the drain pan 104. In some embodiments, the drain pan 104 may be described as having a downstream geometrical footprint 154 that is defined as a space within the air handling unit 100 that is generally obscured from view when viewing the drain pan 104 along the airflow direction 146 from a location upstream of the drain pan 104. In alternative embodiments, a footprint of the drain pan 104 may be defined as a space within the air handling unit 100 to which air is not allowed to reach by traveling in a substantially straight path from the blower 144 as a result of the straight path being obstructed by the presence of the drain pan 104. In this embodiment, at least a portion of the subcooling circuit 108 is located within the footprint 154 of the drain pan 104. In the embodiment shown in FIG. 1, the entirety of the subcooling circuit 108 and a plurality of components of the evaporator circuit 110 lie within the footprint 154 of the drain pan 104. However, in alternative embodiments, more or fewer subcooling circuit 108 components and/or more or fewer evaporator circuit 110 components may lie within the footprint 154 of the drain pan 104.

Although the blower 144 is shown on the bottom side 138 of the cabinet 134, the blower 144 and cabinet 134 may alternatively be configured so that the blower 144 is located on the left side 150 or right side 152 to blow air from left-to-right or right-to-left, respectively, across the heat exchanger 102. The blower 144 may be a centrifugal blower or fan comprising a blower housing, a blower impeller at least partially disposed within the blower housing, and a blower motor configured to selectively rotate the blower impeller to generate airflow. The blower 144 may comprise a variable speed motor, a multiple speed motor, and/or a single speed motor. In operation, airflow generated by the blower 144 may contact the evaporator circuit 110 to facilitate convective heat transfer between the air and the refrigerant within the evaporator circuit 110 so that the air ejected from the air handling unit 100 through outlet 140 may be relatively cooler as compared to the air entering the air handling unit 100 at the inlet 136.

In this embodiment, some physical space of the heat exchanger 102 is allocated to receive the components of the subcooling circuit 108 instead of housing additional components of the evaporator circuit 110. It is recognized that while some amount of cooling based on the evaporation of refrigerant within the evaporator circuit 110 may be foregone due to the above-described allocation of heat exchanger 102 space to the subcooling circuit 108, such cooling opportunity losses may be minimized by allocating spaces of the heat exchanger 102 that experience lower velocity airflow as a result of being relatively more in the geometrical footprint 154 of the drain pan 104 than other portions of the heat exchanger 102. Accordingly, because portions of the heat exchanger 102 that may be underutilized may include portions in the geometrical footprint 154, those underutilized portions may be most appropriately reallocated to house components of the subcooling circuit 108. In operation under some conditions, the subcooling circuit 108 may further cool liquid refrigerant in the subcooling circuit 108 through conductive heat transfer via the end plates 106 and/or any optionally incorporated plate fins of the heat exchanger 102. Under some conditions, refrigerant in the subcooling circuit 108 may be cooled prior to the expansion of the refrigerant caused by the expansion device 112. It is recognized that convective heat transfer between heat exchanger 102 and surrounding air may occur at lower rates for portions of the heat exchanger 102 that lie in the geometrical footprint 154 as compared to portions of the heat exchanger 102 outside the geometrical footprint 154.

Figure 3:
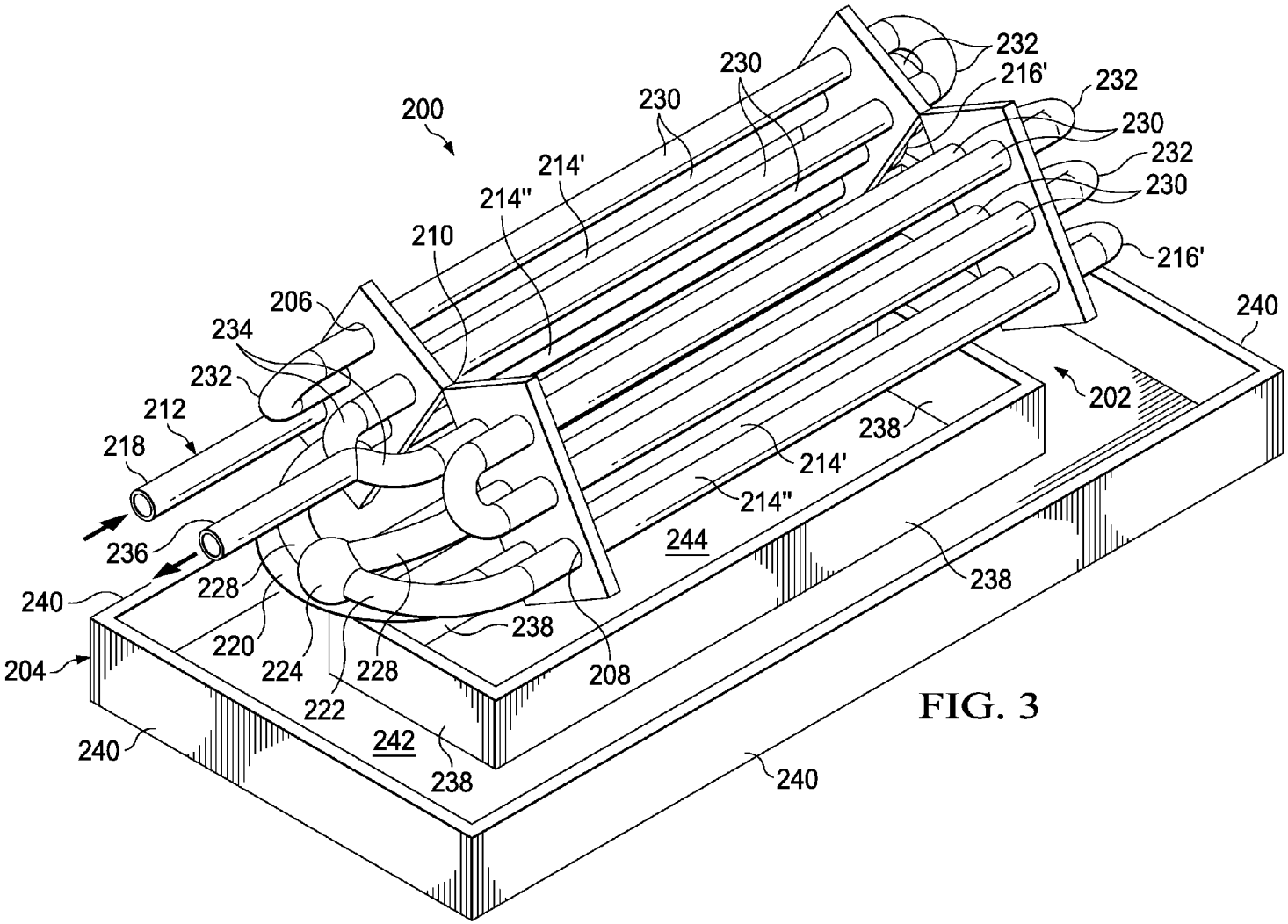
FIG. 3 is a partial oblique view of an air handling unit according to another embodiment of the disclosure.

Referring now to FIG. 3, an oblique partial view of an air handling unit 200 according to an alternative embodiment of the disclosure is shown. Most generally, the air handling unit 200 comprises a heat exchanger 202 and a drain pan 204. The air handling unit 200 may be configured for use in an indoor unit of a split HVAC system. The heat exchanger 202 is configured to receive a substance, such as refrigerant, that may facilitate heat transfer in an HVAC system. Most generally, the heat exchanger 202 comprises a first slab 206 and a second slab 208 oriented relative to each other in a substantially A-shaped arrangement. Such arrangement of the first slab 206 and the second slab 208 may be referred to as an "A coil" heat exchanger because the shape of the heat exchanger 202 looks like two legs of an "A" from an end view perspective. In some embodiments, a general vertex 210 of the heat exchanger 202 is located generally further upstream in a primary airflow through the heat exchanger 202 than other portions of the heat exchanger 202.

Portions of the slabs 206, 208 may be adjacent, if not touching, along the vertex 210 of the A-shaped arrangement. An important difference between the A-shaped heat exchanger 202 and a conventional A coil heat exchanger is that the heat exchanger 202 has at least one built-in subcooling circuit 212 that operates substantially in a similar manner to subcooling circuit 108 as described above. Subcooling circuit 212 comprises a plurality of straight subcooler tubes 214 and subcooler hairpin joints 216. The subcooling circuit 212 further comprises a subcooler inlet 218, a subcooler crossover tube 220, and a subcooler outlet 222. A straight subcooler tube 214' is coupled on one end to subcooler inlet 218 and on the other end to a straight subcooler tube 214" via a subcooler hairpin joint 216'. The remaining end of the straight subcooler tube 214" is connected to the subcooler crossover tube 220 that delivers refrigerant from the first slab 206 portion of the subcooling circuit 212 to the portion of the subcooling circuit 212 that is built into the second slab 208. A straight subcooler tube 214' of the second slab 208 is connected at one end to the subcooler crossover tube 220 and at the remaining end to a straight subcooler tube 214" of the second slab 208 via a subcooler hairpin joint 216' of the second slab 208. The remaining end of the straight subcooler tube 214" is connected to the subcooler outlet 222.

In this embodiment, the subcooler outlet 222 is connected to an input of an expansion device 224 that may simultaneously direct expanded refrigerant into two evaporation circuits 226, one evaporation circuit 226 being located in each of the slabs 206, 208. Each evaporation circuit 226 comprises an evaporator input 228, a plurality of straight evaporator tubes 230, a plurality of evaporator hairpin joints 232, and an evaporator outlet 234. In some embodiments, the evaporator outlets 234 are joined in fluid communication with a singular heat exchanger outlet 236. It is recognized that there are many different possible configurations of subcooling circuits 212 and evaporation circuits 226. In some alternative embodiments, the heat exchanger 202 may comprise subcooling circuit 212 components in only one of the slabs 206, 208.

In this embodiment, the drain pan 204 comprises four inner walls 238, four outer walls 240, and a bottom 242. A central opening 244 in the drain pan 204 provides an area for airflow to reach the heat exchanger 202 from a blower 246 (see FIG. 4). In some embodiments, the drain pan 204 is configured to receive condensate that forms on the heat exchanger 202 during cooling operations.

Figure 4:
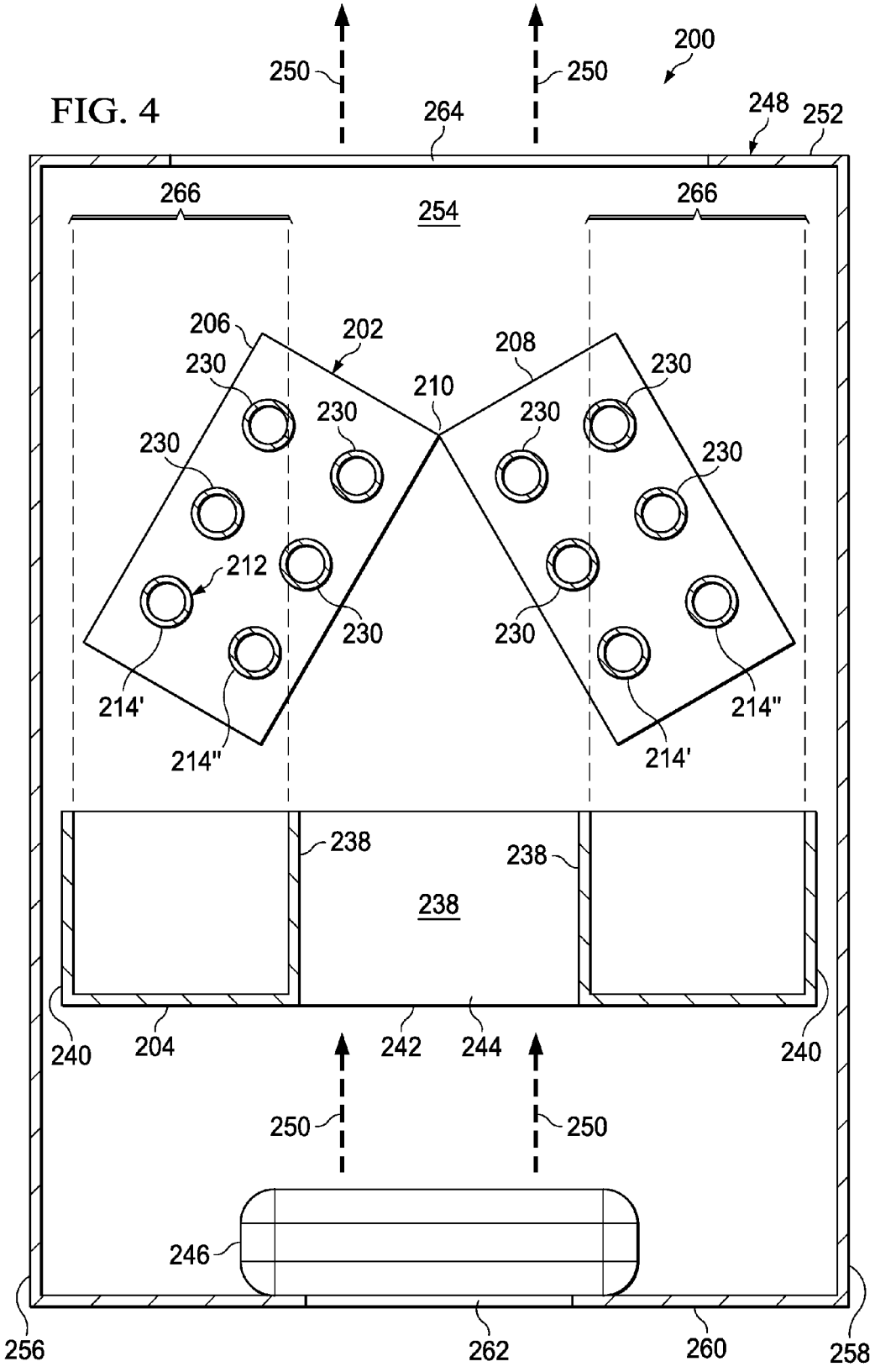
FIG. 4 is a simplified schematic cross-sectional view of the air handling unit of FIG. 3.

Referring now to FIG. 4, a simplified schematic cross-sectional view of the air handling unit 200 is shown. As compared to FIG. 3, the air handling unit 200 is illustrated as further comprising a cabinet 248 substantially enveloping the heat exchanger 202 and drain pan 204. The cabinet 248 and the blower 246 operate substantially similar to the cabinet 134 and the blower 144 to force air in an airflow direction 250 generally from the blower 246 toward the heat exchanger 202 through the central opening 244 of the drain pan 204. In some embodiments, the drain pan 204 may be carried by the cabinet 248 and the heat exchanger 202 may be attached to the drain pan 204 so that the drain pan 204 supports at least part of the weight of the heat exchanger 202. In this embodiment, at least a portion of the drain pan 204 may prevent airflow from reaching the heat exchanger 202 via a substantially straight path in much the same manner described above with regard to the embodiment of FIG. 2.

The cabinet 248 further comprises a front side, a top side 252, a back side 254, a left side 256, a right side 258, and a bottom side 260 each defined by cabinet walls. The bottom side 260 and the top side 252 comprise an air inlet 262 and an air outlet 264, respectively. It will be appreciated that such directional descriptions are meant to assist the reader in understanding the physical orientation of the various components of the air handling unit 200. However, such directional descriptions shall not be interpreted as limitations to the possible installation orientations of the air handling unit 200. The cabinet walls of the air handling unit 200 substantially surround the heat exchanger 202, drain pan 204, and blower 246. The drain pan 204 may be disposed in the air handling unit 200 upstream relative to at least a portion of the subcooling circuit 212. More particularly, in some embodiments, one or more straight subcooler tubes 214 may be located downstream relative to the drain pan 204. In some embodiments, the drain pan 204 may be described as having a downstream geometrical footprint 266 that is defined as a space within the air handling unit 200 that is generally obscured from view when viewing the drain pan 204 along the airflow direction 250 from a location upstream of the drain pan 204. In alternative embodiments, a footprint of the drain pan 204 may be defined as a space within the air handling unit 200 to which air is not allowed to reach a traveling in a substantially straight path from the blower 246 as a result of the straight path being obstructed by the presence of the drain pan 204. In this embodiment, at least a portion of the subcooling circuit 212 is located within the footprint 266 of the drain pan 204. In the embodiment shown in FIG. 4, all of the straight subcooler tubes 214 of the subcooling circuit 212 and a plurality of components of the evaporation circuit 226 lie within the footprint 266 of the drain pan 204. However, in alternative embodiments, more or fewer subcooling circuit 212 components and/or more or fewer evaporation circuit 226 components may lie within the footprint 266 of the drain pan 204.

As described above, portions of slabs 206, 208 lie in the geometrical footprint 266 of drain pan 204 and therefore may be in a lower airflow zone of the air handling unit 200 relative to portions of the heat exchanger 202 outside the footprint 266. For the reasons described above with regard to the embodiment of FIG. 2, because convective heat transfer between heat exchanger 202 and surrounding air may occur at a lower rate than relatively in such lower airflow zones, it makes sense to utilize such portions of the heat exchanger 202 to provide subcooling in place evaporation circuit 226 components. Accordingly, in operation, while the heat exchanger 202 may comprise a reduced capacity evaporation circuit 226, in some operational circumstances, the heat exchanger 202 (including the subcooling circuit 212) as a whole may provide improved performance over a substantially similar heat exchanger 202 that comprises additional evaporation circuit 226 components in place of the subcooling circuit 212 components. In some cases, the air handling unit 200 may provide improved subcooling capacity when used in HVAC systems in "F" test conditions without substantially reducing the efficiency in HVAC systems operating in "A" test conditions. For example, in a 2.5 ton HVAC system operating in a cooling mode, the use of four straight subcooler tubes 214, two in each slab 206, 208, may increase subcooling from 0° F. to about 14° F. by recondensing the refrigerant with inlet air that is colder than the refrigerant temperature.

Figure 5:
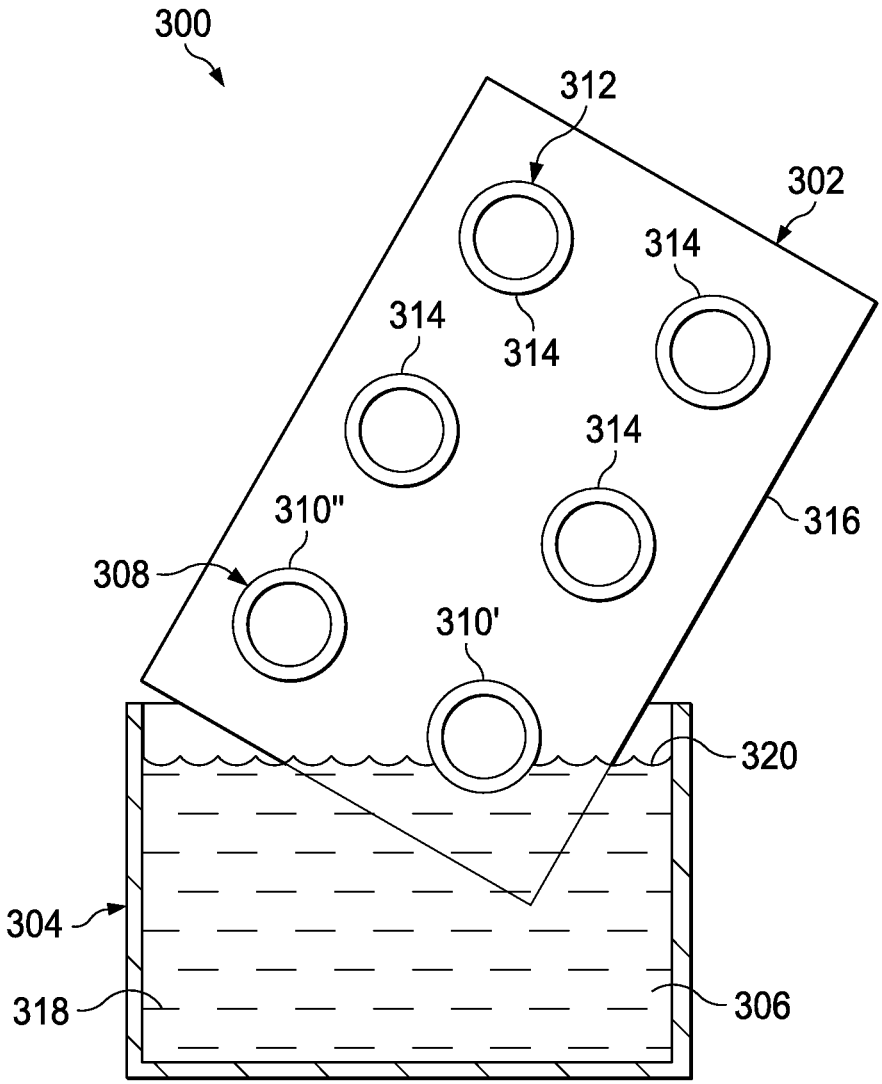
FIG. 5 is a partial oblique view of an air handling unit according to still another embodiment of the disclosure.

Referring now to FIG. 5, a simplified schematic cross-sectional view of an air handling unit 300 is shown. The air handling unit 300 comprises a heat exchanger 302 and a drain pan 304. Most generally, the drain pan 304 comprises a concavity 306 that is open in a generally upward direction. In this embodiment, a subcooling circuit 308 comprises straight subcooler tubes 310 and an evaporation circuit 312 comprises straight evaporator tubes 314. In some embodiments, one or more of the components of the subcooling circuit 308 and the evaporation circuit 312 are carried by an end plate 316. While in some of the embodiments described above with regard to FIGS. 1-4 provide for conductive heat transfer between the components of the subcooling circuits 108, 212 and the evaporation circuits 110, 226, respectively, via end plates and/or plate fins, the embodiment of FIG. 5 further provides for conductive heat transfer between the subcooling circuit 308 and condensate 318 that may be at least temporarily held in the concavity 306 of the drain pan 304.

In operation, condensate may form on heat exchanger 302 while the air handling unit 300 is operated in a cooling mode. Gravity may thereafter assist transport of the condensate from a surface of the heat exchanger 302 to the concavity 306. As condensate 318 gathers in the drain pan 304, a condensate level 320 may rise. In cases where the condensate level 320 rises sufficiently so that condensate 318 at least partially envelopes a portion of the end plate 316 and at least a portion of the subcooling circuit 308, the cool condensate 318 may serve as a heat sink to which heat from the refrigerant in the subcooling circuit 308 may be directed. For example, because the straight subcooler tube 310' itself may be in contact with the condensate 318 directly, heat may be transferred from within the straight subcooler tube 310' to the condensate via a conduction heat transfer path comprising one or both of the straight subcooler tube 310' itself and the adjacent portions of the end plate 316. However, heat from within the straight subcooler tube 310" that is conductively passed to the condensate requires a conduction heat transfer path that comprises both the straight subcooler tube 310" itself and the adjacent portions of the end plate 316 because the straight subcooler tube 310 is not located within the concavity 306 and therefore cannot directly contact the condensate 318 pooled in the drain pan 304. It will be appreciated that any of the above-described embodiments of air handling units may be modified to comprise an option for such conductive heat transfer between a subcooling circuit and condensate at least temporarily retained within a concavity of a drain pan. Further, because portions of the heat exchanger 302 are located within a concavity 306 of the drain pan 304, the airflow rate across those portions of the heat exchanger 302 may be relatively lower as compared airflow rates across portions of the heat exchanger 302 located outside the concavity 306. As explained above, it follows that locating subcooling circuit 308 components within the relatively lower airflow areas may provide the air handling unit 300 with improved subcooling capability when used in HVAC systems in "F" test conditions without substantially reducing the efficiency in HVAC systems operating in "A" test conditions.

This disclosure further contemplates a method of assembling an air handling unit. The method may be directed to assembling any of the air handling units disclosed herein. The method may comprise providing a heat exchanger, the heat exchanger comprising a thermal conductor, at least one evaporator tube thermally conductively joined to the thermal conductor, at least one subcooler tube thermally conductively joined to the thermal conductor, and an expansion device providing fluid communication between the at least one evaporator tube and the at least one subcooler tube. The method may further comprise mounting a housing in a surrounding relationship to said heat exchanger, the housing having an air inlet end and an air outlet end, providing a blower within the housing positioned to move air from the air inlet end to the air outlet end of the housing along an airflow direction extending from the blower to the air outlet end, and positioning a drain pan within the housing upstream relative to the at least one subcooler tube so that the at least one subcooler tube lies in a footprint of at least a portion of the drain pan as the drain pan is viewed from an upstream position and in the airflow direction.

Embodiments disclosed herein may be used in an indoor heat exchanger in a split HVAC system intended for residential or commercial buildings. Split HVAC systems are well known in the art and typically comprise an indoor heat exchanger, an outdoor heat exchanger, and a means for passing refrigerant between the heat exchangers, such as pipes, conduit, or other type of tubular connections. Although the AHRI "A" and "F" tests described earlier refer to systems that employ either a two-speed or a variable-speed compressor, the embodiments discussed herein may also be also be used in HVAC systems with a single-speed compressor. In each of the embodiments, the number of tubes, the positioning of the apertures in the end plates and/or plate fins, the shapes of the tubes, and the heat exchange properties of the tubes, plates, and fins may be varied.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Further, while the claims herein are provided as comprising specific dependencies, it is contemplated that any claims may depend from any other claims and that to the extent that any alternative embodiments may result from combining, integrating, and/or omitting features of the various claims and/or changing dependencies of claims, any such alternative embodiments and their equivalents are also within the scope of the disclosure.

The invention claimed is:

1. An air handling unit, comprising:

a blower configured to selectively move air from an air inlet of the air handling unit to an air outlet of the air handling unit along an airflow direction extending from the blower to the air outlet;

a heat exchanger comprising a first slab and a second slab, each slab comprising an upper end and a lower end and disposed within the air handling unit between the air inlet and the air outlet such that the upper end is located nearer the air outlet than the lower end, and each slab of the heat exchanger further comprising:

at least one thermally conductive fin;

an evaporator circuit comprising at least one evaporator tube (1) comprising an evaporator tube inlet and an evaporator tube outlet and (2) disposed through and thermally conductively joined to the at least one thermally conductive fin at the upper end of the heat exchanger; and a subcooler circuit comprising;

a first subcooler tube comprising a subcooler tube inlet; and a second subcooler tube joined to the first subcooler tube by a hairpin joint, the second subcooler tube comprising a subcooler tube outlet, wherein each of the first subcooler tube and the second subcooler tube are disposed through and thermally conductively joined to the at least one thermally conductive fin at the lower end of the heat exchanger;

a subcooler crossover tube that delivers refrigerant from the subcooler tube outlet of the second subcooler tube of the first slab to the subcooler tube inlet of the first subcooler tube of the second slab;

an expansion device providing fluid communication between the evaporator tube inlet of the at least one evaporator tube of the evaporator circuit of each of the first slab and the second slab and the subcooler tube outlet of the second subcooler tube of the subcooler circuit of the second slab, wherein the expansion device comprises only one inlet and the inlet is connected in fluid communication with the subcooler tube outlet of the second subcooler tube of the subcooler circuit of the second slab; and a drain pan disposed within the air handling unit upstream relative to the heat exchanger, wherein the first subcooler tube and the second subcooler tube of the subcooler circuit of each of the first slab and the second slab is positioned in a geometrical footprint of the drain pan as the drain pan is viewed from an upstream position in the primary airflow direction.

2. The air handling unit of claim 1, wherein the drain pan comprises a concavity configured to receive condensate from the heat exchanger when the concavity is generally open in a vertically upward direction.

3. The air handling unit of claim 2, wherein (1) at least a portion of at least one of the first subcooler tube and the second subcooler tube and (2) at least a portion of the thermally conductive fin are received within the concavity.

4. The air handling unit of claim 1, wherein the first slab and the second slab are configured in a substantially A-shaped arrangement.

5. The air handling unit of claim 1, wherein in each slab all evaporator tubes are located downstream relative to the first subcooler tube and the second subcooler tube.

6. The air handling unit of claim 5, further comprising; a housing in a surrounding relationship to the heat exchanger, wherein the drain pan is secured to the housing and the drain pan provides support for the heat exchanger.

7. The air handling unit of claim 1, wherein the drain pan is configured to prevent air from the blower from reaching at least one of the first subcooler tube and the second subcooler tube of the subcooler circuit of each of the first slab and the second slab in a substantially straight path from the blower to the subcooler tubes as a result of at least one subcooler tube of the subcooler circuit of each of the first slab and the second slab being positioned in the geometrical footprint of the drain pan.

8. An HVAC system, comprising:

a heat exchanger comprising:

a first slab; and a second slab;

wherein each of the first slab and the second slab comprise:

at least one thermally conductive fin;

an evaporator circuit comprising at least one evaporator tube (1) comprising an evaporator tube inlet and an evaporator tube outlet and (2) disposed through and thermally conductively joined to the at least one thermally conductive fin at an upper end of the heat exchanger; and a subcooler circuit comprising a first subcooler tube comprising a subcooler tube inlet; and a second subcooler tube joined to the first subcooler tube by a hairpin joint, the second subcooler tube comprising a subcooler tube outlet wherein each of the first subcooler tube and the second subcooler tube are disposed through and thermally conductively joined to the at least one thermally conductive fin at a lower end of the heat exchanger;

a subcooler crossover tube that delivers refrigerant from the subcooler tube outlet of the second subcooler tube of the first slab to the subcooler tube inlet of the first subcooler tube of the second slab;

an expansion device providing fluid communication between the evaporator tube inlet of the at least one evaporator tube of the evaporator circuit of each of the first slab and the second slab and the subcooler tube outlet of the second subcooler tube of the subcooler circuit of the second slab, wherein the expansion device comprises only one inlet and the inlet is connected in fluid communication with the subcooler tube outlet of the second subcooler tube of the subcooler circuit of the second slab; and a drain pan comprising a concavity configured to receive condensate from the heat exchanger when the concavity is generally open in a vertically upward direction;

wherein at least a portion of at least one of the first subcooler tube and the second subcooler tube of the subcooler circuit of each of the first slab and the second slab and the thermally conductive fin are received within the concavity.

9. The HVAC system of claim 8, wherein the first slab and the second slab of the heat exchanger are configured in a substantially A-shaped arrangement.

10. The HVAC system of claim 9, further comprising a housing in a surrounding relationship to the heat exchanger, wherein the drain pan is secured to the housing and the drain pan provides support for the heat exchanger.

11. The HVAC system of claim 8, wherein the drain pan is configured to prevent air from the blower from reaching at least one of the first subcooler tube and the second subcooler tube of the subcooler circuit of each of the first slab and the second slab in a substantially straight path from the blower to the subcooler tubes as a result of at least one subcooler tube of the subcooler circuit of each of the first slab and the second slab being positioned in the concavity of the drain pan.

12. A method of assembling an air handling unit, comprising:

providing a heat exchanger, the heat exchanger comprising:

a first slab; and a second slab, each of the first slab and the second slab comprising:

at least one thermally conductive fin;

an evaporator circuit comprising at least one evaporator tube (1) comprising an evaporator tube inlet and an evaporator tube outlet and (2) disposed through and thermally conductively joined to the at least one thermally conductive fin at an upper end of the heat exchanger;

a subcooler circuit comprising a first subcooler tube (1) comprising a subcooler tube inlet; and a second subcooler tube joined to the first subcooler tube by a hairpin joint, the second subcooler tube comprising a subcooler tube outlet disposed through and thermally conductively joined to the at least one thermally conductive fin at a lower end of the heat exchanger; and an expansion device providing fluid communication between the evaporator tube inlet of the at least one evaporator tube of the evaporator circuit of each of the first slab and the second slab and the subcooler tube outlet of the at least one subcooler tube of the subcooler circuit of the second slab, wherein the expansion device comprises only one inlet and the inlet is connected in fluid communication with the subcooler tube outlet of the at least one subcooler tube of the subcooler circuit of the second slab;

mounting a housing in a surrounding relationship to said heat exchanger, the housing comprising an air inlet and an air outlet;

providing a blower within the housing positioned to move air from the air inlet to the air outlet of the housing along a primary airflow direction extending from the blower to the air outlet; and positioning a drain pan within the housing upstream relative to the subcooler circuit of the first slab and the second slab so that at least a portion of at least one of the first subcooler tube and the second subcooler tube of the subcooler circuit of each of the first slab and the second slab lies in a geometrical footprint of the drain pan as the drain pan is viewed from an upstream position in the primary airflow direction, and so that at least a portion of the evaporator circuit lies outside the geometric footprint of the drain pan as the drain pan is viewed from an upstream position in the primary airflow direction.

13. The method of claim 12, wherein the first slab and the second slab of the heat exchanger are configured in a substantially A-shaped arrangement.

14. The method of claim 12, further comprising securing the drain pan to the housing, wherein the drain pan is positioned to provide support for the heat exchanger.

15. The method of claim 12, further comprising:

preventing air from the blower from reaching at least one of the first subcooler tube and the second subcooler tube of the subcooler circuit of each of the first slab and the second slab in a substantially straight path from the blower to the subcooler tubes.

* * * * *